United States Patent [19]

Beauregard

[11] 4,026,310

[45] May 31, 1977

[54] DRYING BOX FOR FOOTBALLS

[75] Inventor: Arthur A. Beauregard, Cumberland, R.I.

[73] Assignee: The Raymond Lee Organization, Inc., New York, N.Y. ; a part interest

[22] Filed: July 26, 1976

[21] Appl. No.: 708,330

[52] U.S. Cl. ..... 134/86; 134/103; 134/149; 15/302; 34/90; 34/105

[51] Int. Cl.[2] ..... B08B 3/02

[58] Field of Search ..... 15/21 A, 34, 36, 302, 15/310–311; 134/84–92, 103, 201, 115 R, 149; 34/90, 104, 105

[56] References Cited

UNITED STATES PATENTS

| | | | |
|---|---|---|---|
| 2,643,465 | 6/1953 | Douglass | 34/104 X |
| 3,012,334 | 12/1961 | Davis, Jr. | 15/21 A X |
| 3,078,591 | 2/1963 | Carpenter | 15/21 A |
| 3,121,437 | 2/1964 | Tomchak | 134/86 X |
| 3,152,875 | 10/1964 | Davis, Jr. et al. | 34/104 |

*Primary Examiner*—Robert L. Bleutge
*Attorney, Agent, or Firm*—Howard I. Podell

[57] ABSTRACT

A portable cabinet which is fitted with means for washing and drying one or more footballs. The cabinet is fitted with a hinged top cover, with the several compartments of the cabinet open to the top. A central compartment is fitted with a battery power supply connected by switching and a timer to a motor mounted in the central compartment. The motor is joined by a first shaft to an air blower in one side compartment mounted below an electrical heating element and to a water circulating pump mounted in the second side compartment, connected to circulate water from a storage tank through a shower spray head mounted in the top of the second compartment onto a football detachably mounted to a second shaft joined by belt and pulleys to the motor shaft. A football may be detachably mounted to the second shaft in the first side compartment above the heating element.

1 Claim, 5 Drawing Figures

DRYING BOX FOR FOOTBALLS

SUMMARY OF THE INVENTION:

My invention is a portable cabinet which is fitted with means for washing and drying one or more footballs. The cabinet is fitted with a hinged top cover, with the several compartments of the cabinet open to the top. A central compartment is fitted with a battery power supply connected by switching and a timer to a motor mounted in the central compartment. The motor is joined by a first shaft to an air blower in one side compartment mounted below an electrical heating element and to a water circulating pump mounted in the second side compartment, connected to circulate water from a storage tank through a shower spray head mounted in the top of the second compartment onto a football detachably mounted to a second shaft joined by belt and pulleys to the motor shaft. A football may be detachably mounted to the second shaft in the first side compartment above the heating element.

BRIEF DESCRIPTION OF THE DRAWINGS:

The objects and features of the invention may be understood with reference to the following detailed description of an illustrative embodiment of the invention, taken together with the accompanying drawings in which.

Figure 1:
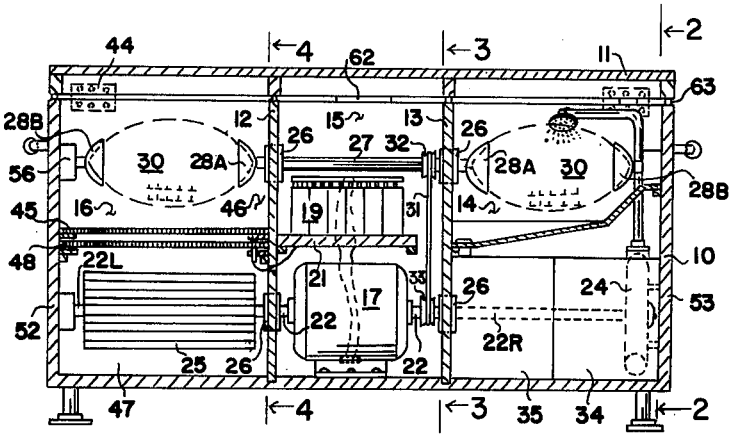
FIG. 1 is an elevation section view of the invention.
Figure 2:
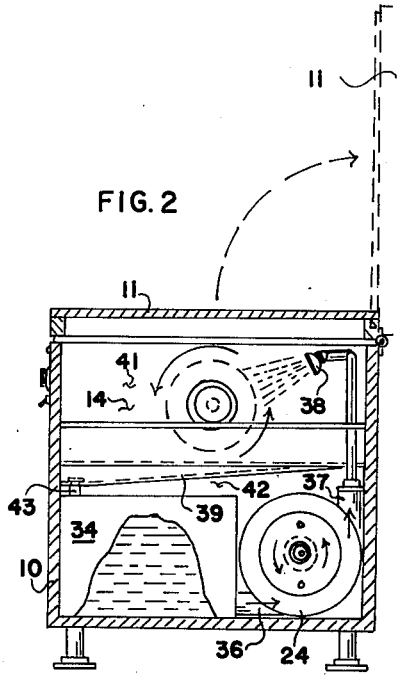
FIG. 2 is a sectional view taken along line 2—2 of FIG. 1.

DESCRIPTION OF THE PREFERRED EMBODIMENT:

Turning now descriptively to the drawings, in which similar reference characters denote similar elements throughout the several views, FIGS. 1–4 illustrate the cabinet 10 joined by a hinge 44 to top cover 11 and internally fitted with two vertical partitions 12 and 13 that divide the cabinet internally into a washing compartment 14 on a first side of a central compartment 15 and a drying compartment 16 on the second side of central compartment 15.

Central compartment 15 is fitted with a motor 17 mounted to the base 18 of the cabinet below a battery 19 mounted on a shelf 21.

A first drive shaft 22 extends from both sides of motor 17, with shaft section 22R extending into the washing compartment 14 and shaft section 22L extending into the drying compartment 16 to drive a water pump 24 and an air blower 25 respectively, with partition 12 and 13 fitted with sealed bearings 26 about drive shaft 22.

A second shaft 27 is rotatably fixed in a pair of sealed bearings 26 in partition walls 12 and 13 above motor 17 and parallel to first drive shaft 22 to extend into both side compartments 14 and 16 fixed in each compartment 14 and 16 to a flexible mounting cup 28A of a size to grip the elliptical end section 29 of a football.

Shaft 27 is linked to shaft 22 by belt 31 and pulleys 32 and 33.

A water storage tank 34 and a water collection tank 35 are mounted to the base 18 in the lower section 42 of washing compartment 14, with storage tank 34 joined by pump inlet pipe 36 to pump 24. The outlet pipe 37 of pump 24 leads to one or more shower heads 38 mounted in upper section 39 chamber 14 and located to spray water onto a football 30 mounted between a pair of mounting cups 28A and 28B so as to rotate when shaft 27 is driven by motor 17. A sink basin 39 separates upper chamber section 41 from lower chamber section 42, with a drain 43 in sink basin 39 leading to collection tank 35.

Drying chamber 16 is divided by a horizontal screen 45 into an upper chamber 46 and a lower chamber 47 with an electrical heater element 48 mounted below screen 45 and above blower 25. Vents 49 are located in the rear wall 51 of drying chamber 16 for both air intake into lower chamber 47 and air exhaust from upper chamber 46.

Figure 5:
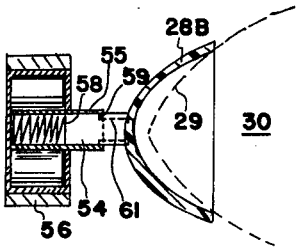
FIG. 5 is a sectional view of the mounting cup assembly.
Figure 3:
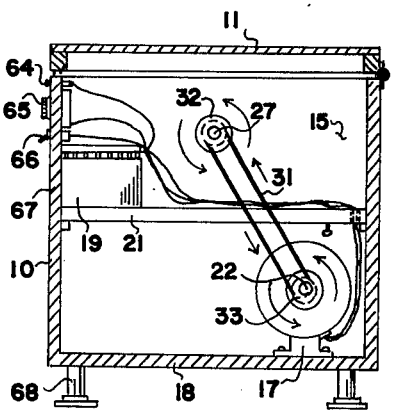
FIG. 3 is a sectional view taken along line 3—3 of FIG. 1.
Figure 4:
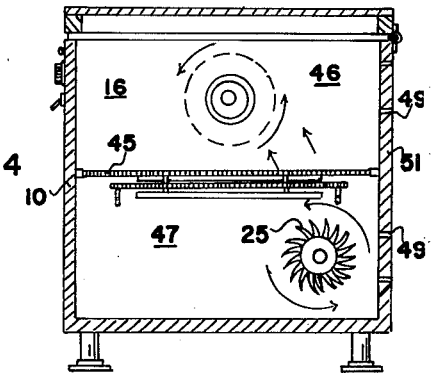
FIG. 4 is a sectional view taken along line 4—4 of FIG. 1.

As shown in FIGS. 1 and 5, a flexible rubber cup 28B of the size of cup 28A is rotatably mounted along the axis of shaft 27 to the end walls 52 and 53 of chamber 16 and 14 respectively, with each cup 28B fixed to a shaft 54 slidably mounted in a collar 55 fitted to a roller bearing 55 fixed to the respective end wall 52, 53. A compression spring 58 biases shaft 54 axially away from the attached side wall 52, 53 with a detent 59 of collar 55 in a groove 61 of shaft 54 to prevent release of shaft 54 from collar 55, so that cup 28B will detachably grip a football 30 located between a cup 28A and a cup 28B of a compartment 16 or 14.

Cover 11 is fitted with a magnetic latch 62 to maintain it in the closed position and sealing strips 63 are located on the adjoining edges of cover 11 and cabinet 10.

An indicator light 64, a timer unit 65 and a switch 66 are mounted to the front wall 67 of cabinet 10 and wired to the battery and motor in conventional manner.

Cabinet 10 is fitted with mounting legs 68 to raise the cabinet above the ground level.

Alternately, motor 17 may be powered by a line cord (not shown) leading to an external source of electrically, and a plurality of shifts (not shown) may be linked to and mounted parallel to shaft 27 to increase the number of footballs that may be simultaneously processed.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A portable cabinet for washing and drying a football comprising a cabinet housing a motor mounted in a first compartment, a motor powered water circulating means leading to a spray unit located in a second compartment, a motor powered air blower unit leading to an air heating means located in a third compartment, said motor joined to shafting fitted with means to attach a football in said second and said third compartments to rotate said attached footballs for the purpose of washing and drying respectively, and the water circulating means and the air blower unit are both powered by the said motor.

* * * * *